United States Patent [19]

Arvanigian

[11] Patent Number: 4,746,061

[45] Date of Patent: May 24, 1988

[54] TAMPER-PROOF SHIPPING CONTAINER

[76] Inventor: George B. Arvanigian, 5029 Angling Rd., Kalamazoo, Mich. 49002

[21] Appl. No.: 36,780

[22] Filed: Apr. 10, 1987

[51] Int. Cl.[4] ..... B65D 5/02

[52] U.S. Cl. ..... 229/102; 206/807; 229/125.37; 229/136; 229/DIG. 2

[58] Field of Search ..... 229/102, 132, 134, 136, 229/DIG. 2, 125.37, 123.2; 206/807

[56] References Cited

U.S. PATENT DOCUMENTS

| | | | |
|---|---|---|---|
| 1,845,891 | 2/1932 | Schroeder | 229/DIG. 2 |
| 1,912,698 | 6/1933 | Forsman | 229/DIG. 2 |
| 2,833,404 | 5/1958 | Jacobs et al. | 229/DIG. 2 |
| 4,516,679 | 5/1985 | Simpson et al. | 206/807 |

FOREIGN PATENT DOCUMENTS

| | | | |
|---|---|---|---|
| 61-273340 | 12/1986 | Japan | 229/102 |

OTHER PUBLICATIONS

Package Engineering, vol. 28, #2; p. 115, 2-1983.

*Primary Examiner*—Stephen Marcus
*Assistant Examiner*—Gary E. Elkins
*Attorney, Agent, or Firm*—Flynn, Thiel, Boutell & Tanis

[57] ABSTRACT

A corrugated cardboard carton has opposed foldable outer flaps associated with the top and bottom ends thereof which overlap inner flaps in a conventional manner, with the opposed outer flaps being sealed together adjacent their free edges. To create a tamper-resistant seal between the outer flaps, the flaps terminate in free edges which effectively abut when the carton is closed, which free edges are defined by the inner facing layer and the intermediate corrugated layer of the board stock defining the flaps. The outer facing layer of the board stock defining the flaps is provided with a securing strip which is integral therewith and which projects outwardly beyond the free edge. This securing strip has cuts or openings therethrough. The outer facing layer of the flap also has an indicator strip, preferably of a bright color, formed on the exterior face thereof. When the opposed outer flaps are closed, the securing strip on one flap overlaps the outer facing layer of the other flap and is adhesively sealed thereto. The cuts or openings associated with the one flap are disposed directly over the indicator strip on the other flap. Any unauthorized unsealing of the strip results in the cuts or openings being visually distorted.

4 Claims, 2 Drawing Sheets

TAMPER-PROOF SHIPPING CONTAINER

FIELD OF THE INVENTION

This invention relates to a sealed carton, particularly of corrugated cardboard, having an improved tamper-indicating sealing structure associated therewith.

BACKGROUND OF THE INVENTION

There has been available various sealed cartons or packages which, under normal circumstances, must be torn open or in some respect destroyed in order to permit access to the contents. These cartons have typically employed overlapping panels or flaps which are adhesively bonded to carton walls so that opening of the carton effectively destroys the carton and provides visual indication that someone has gained access to the carton interior.

To improve upon these cartons, some carton designs have employed sealed flaps having cuts or perforations therein which define a score line, whereby any attempt to gain access by breakage of the seal causes distortion or tearing of the flap. These arrangement again provide visual evidence of any alleged tampering with the carton. Structures of this type are illustrated by U.S. Pat. Nos. 4,508,226, 4,479,588, 4,434,896 and 4,573,634.

While cartons of the aforementioned type are satisfactory, nevertheless they are limited as to their field of application. That is, these known cartons are typically constructed of paperboard, the latter basically comprising a single ply or layer, with the cartons being of small size so as to typically contain therein a single object, such as a tube of toothpaste. Further, the tamper-resistant sealed closure associated with these paperboard cartons has been designed so as to be primarily suitable solely with paperboard, and as such the known tamper-resistant arrangements have not been suitable for use with heavier cartons, such as larger shipping cartons of the type constructed from corrugated cardboard.

At the present time, large and heavy-duty boxes constructed of corrugated cardboard are used for shipping many products, such as the bulk shipment of food products and the like. Such corrugated cardboard cartons, however, have not been provided with any satisfactory means of providing an effective tamper-resistant seal structure.

Accordingly, it is an object of the present invention to provide an improved carton constructed of corrugated cardboard and provided with a tamper-resistant closure or sealing structure associated therewith.

More specifically, it is an object of this invention to provide an improved corrugated cardboard carton, as aforesaid, wherein the carton has opposed foldable outer flaps associated with the top and bottom ends of the carton, which opposed outer flaps overlap inner flaps in a conventional manner, with the opposed outer flaps being sealed together adjacent their free edges. To create a tamper-resistant seal structure between the outer flaps, the flaps terminate in free edges which effectively abut when the carton is closed, which free edges are defined solely by the inner facing layer and the intermediate corrugated layer of the board stock defining the flaps. The outer facing layer of the board stock defining the flaps, however, is provided with a securing strip which is integral therewith and which projects outwardly beyond the free edge. This securing strip is provided with cuts or openings therethrough. The outer facing layer of the flap also has an indicator strip, preferably of a bright color, formed on the exterior face thereof and extending longitudinally along the flap adjacent to but spaced slightly inwardly from the free edge. When the opposed outer flaps are closed so that the free edges are disposed closely adjacent but in nonoverlapping relationship, the securing strip on one flap overlaps the outer facing layer of the other flap and is adhesively sealed thereto. The cuts or openings associated with the one flap are disposed directly over the indicator strip on the other flap. Hence, any unauthorized attempt to unseal the strip and then reseal the carton results in the cuts or openings being distorted, and such distortion is particularly evident due to the bright color of the underlying indicating strip. Unauthorized opening or tampering of the shipping carton can thus be readily observed.

Other objects and purposes of the invention will be apparent to persons familiar with structures of this general type upon reading the following specification and inspecting the accompanying drawings.

Figure 1:
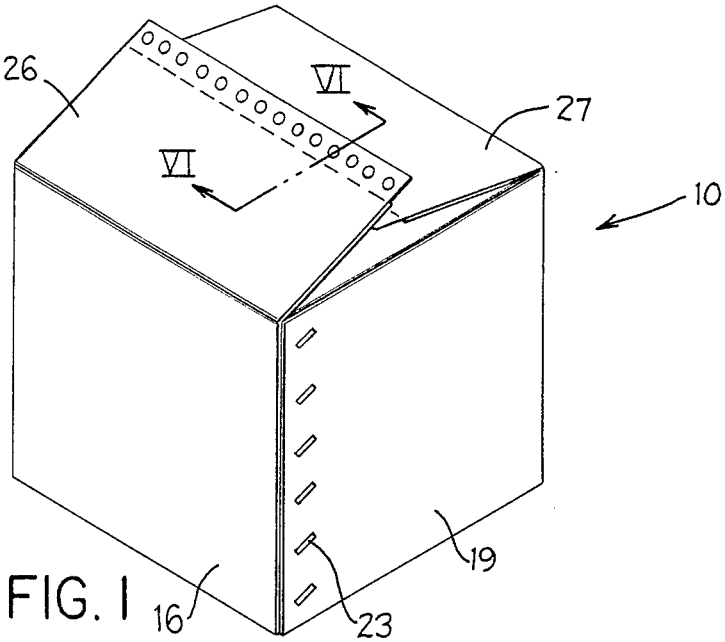
FIG. 1 is a perspective view of a carton according to the present invention, same being illustrated with the flaps partially closed but prior to sealing thereof.
Figure 2:
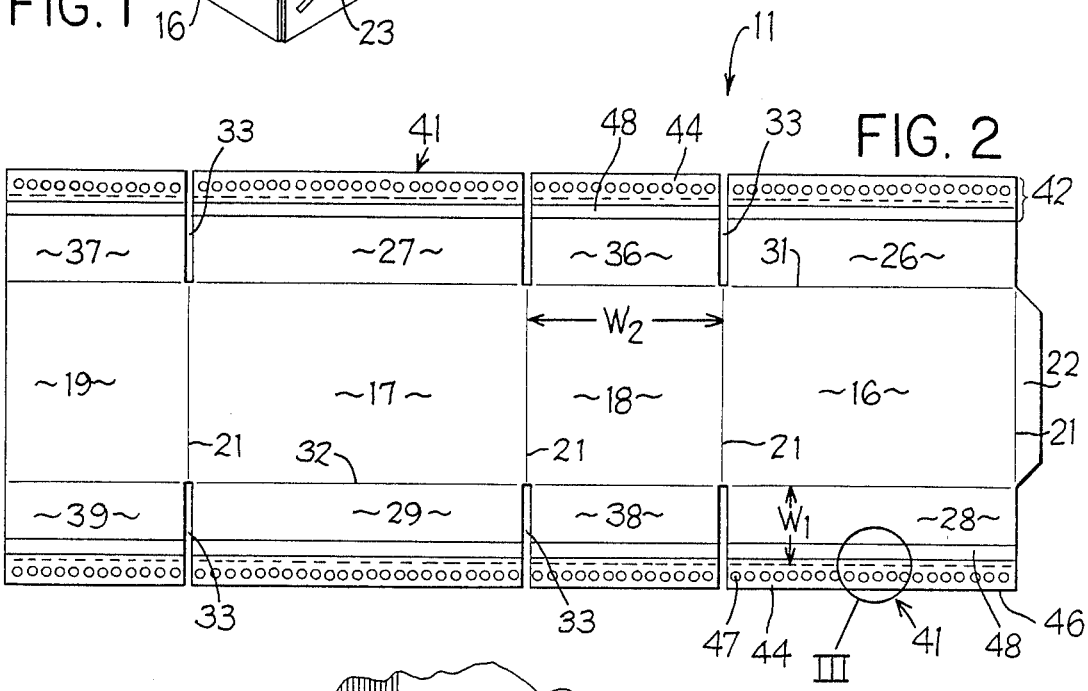
FIG. 2 illustrates a plan view of the foldable blank used for forming the carton.

Certain terminology will be used in the following description for convenience in reference only, and will not be limiting. For example, the words "rightwardly", "leftwardly", "upwardly" and "downwardly" will refer to directions in the drawings to which reference is made. The words "inwardly" and "outwardly" will refer to directions toward and away from, respectively, the geometric center of the carton or blank or designated parts thereof. Such terminology will include the words specifically mentioned, derivatives thereof and words of similar import.

DETAILED DESCRIPTION

Figure 5:
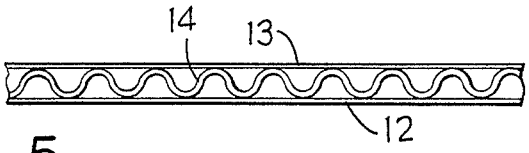
FIG. 5 is a fragmentary sectional view taken along line V—V in FIG. 4.

Referring to the drawings, there is illustrated a sealable container or box 10 according to the present invention, which box 10 is formed from a flat blank 11. The blank 11 for forming the box is constructed from conventional corrugated cardboard which, as illustrated by FIG. 5, is of conventional multi-ply construction in that it includes thin inner and outer facing sheets 12 and 13, respectively, adhesively bonded on opposite sides of an intermediate corrugated sheet 14.

The blank 11 used for forming the container 10 is of a generally conventional configuration in that it defines opposed rectangular side walls 16 and 17 which are joined between opposed rectangular end walls 18 and 19. The walls 16–19 are joined integrally in series and are separated by transversely extending fold or score lines 21. The side wall 16, at the free edge thereof, has an outwardly projecting glue strip 22 which is also separated from the side wall by a fold line 21, and this glue strip 22 is adapted to overlap and be adhesively secured to the inner surface of the end wall 19 when the blank is assembled to form the closed box. The end wall 19 and the overlapping glue strip 22 are also preferably mechanically secured, such as by staples 23, to provide a tamper-resistant sealing of the side and end walls together.

The container 10 also includes "outer" top and bottom flaps 26 and 28, respectively, which project outwardly from the opposite edges of the side wall 16. Similar outer top and bottom flaps 27–29, respectively, project out from opposite edges of the other side wall 17. The flaps 26–29 are, in the preferred embodiment, all of identical construction and size, whereby the top flaps 26 and 27 define an opposed pair for sealingly closing the upper end of the container, and similarly the bottom flaps 28 and 29 define an opposed pair for sealingly closing the bottom of the container, as explained in greater detail hereinafter.

The top flaps 26 and 27 are integrally joined to the respective side wall through a fold line 31 which extends longitudinally throughout the length of the blank 11. A similar fold line 32 extends longitudinally of the blank so as to define the transition between the bottom flaps 28–29 and their connection to the respective side walls.

Container 10 also includes additional or "inner" flaps which are disposed under the outer flaps when the container is assembled. More specifically, the inner flaps include top and bottom flaps 36 and 38 which are joined to the one end wall 18, and a further pair of top and bottom flaps 37 and 39 which are joined to opposite edges of the other end wall 19.

The longitudinally adjacent pairs of flaps are separated by intermediate slots or slits 33 which are aligned with the transverse fold lines 21 and project inwardly from the longitudinal free edges so as to terminate at the longitudinal fold lines 31 and 32.

In forming the box 10 using the blank 11 of the present invention, the box is formed in a substantially conventional manner. That is, the box is folded about the fold lines 21 so as to form a generally rectangular tube, and the flap 22 is disposed under the end wall 19 and is secured thereto, such as by an adhesive and by staples 23. The inner pairs of flaps, such as the opposed pair of top flaps 36–37 and the opposed pair of bottom flaps 38–39, are then folded inwardly about the fold lines 31 and 32. Thereafter, the opposed pairs of outer flaps are folded inwardly so as to overlie the inner flaps. That is, the opposed pair of top flaps 26–27 and the opposed pair of bottom flaps 28–29 are folded inwardly to respectively overlie the inner flaps. The opposed pair of top flaps 26–27, and similarly the opposed pair of bottom flaps 28–29, are then suitably sealed together to close the box 10.

The overall arrangement of the box 10, and the manner in which the flaps are formed and cooperate as described above, is conventional.

Considering now the present invention, the outer flaps 26–29 are provided with a tamper-indicating sealing means 41 which enables the opposed pairs 26–27 and 28–29 to be sealingly coupled to one another and at the same time provide an indication if the seal has been tampered with (such as loosened and resealed).

More specifically, the tamper-indicating sealing means 41 is associated with the edge structure 42 as defined on and extending longitudinally along each of the flaps 26–29. In fact, in the illustrated embodiment, this means 41 is associated with the edge structure of all of the flaps since this greatly facilitates manufacture of the blank since the tamper-indicating sealing means 41 can thus be formed directly along the blank in a continuous longitudinal strip during the forming of the blank.

Figure 4:
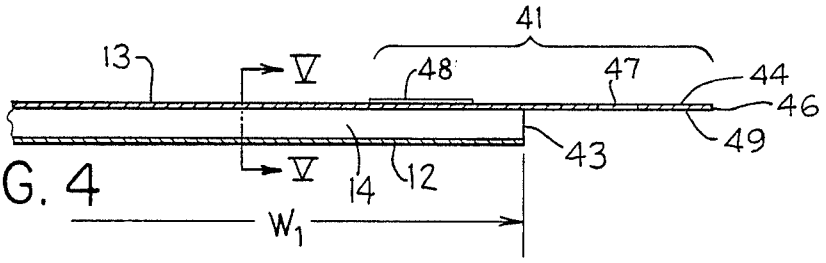
FIG. 4 is a fragmentary sectional view taken substantially along line IV—IV in FIG. 3.

As illustrated by FIG. 4, each flap 26–29 terminates in a free longitudinally extending edge 43, which edge defines the terminus of solely the inner facing sheet 12 and the intermediate corrugated layer 14. The flaps 26–29 each have a width $W_1$, as measured from the respective fold line 31 or 32 to the free edge 43, which is approximately equal to but normally slightly smaller than one-half of the box width $W_2$, which width $W_2$ corresponds to the width of the end wall 18 or 19. When the opposed pairs of outer flaps 26–27 and 28–29 are folded inwardly into a closing position, the flaps do not overlap, but rather the free edges 43 are disposed in closely opposed relationship to one another similar to that illustrated by FIG. 6.

Figure 3:
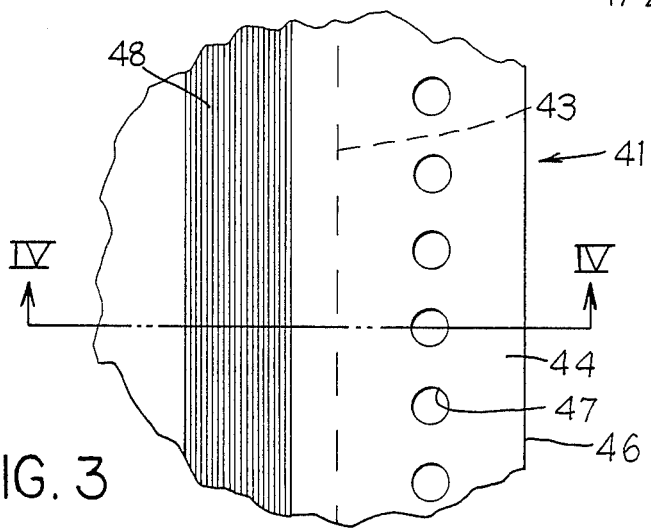
FIG. 3 is an enlargement of the tamper-indicating seal means associated with the free edge of the carton flaps, corresponding substantially to the circled portion designated III in FIG. 2.

The tamper-indicating sealing means 41 is defined in its entirety by the upper facing sheet 13 associated with the opposed pair of flaps, with this means 41 being disposed in the vicinity of the free edge 43. As illustrated by FIGS. 3 and 4, the upper facing sheet 13 is integrally extended outwardly through a selected extent beyond the free edge 43 so that the top facing sheet 13 itself terminates in a free longitudinally extending edge 46 which is spaced outwardly from the free edge 43. The top facing sheet 13 hence defines thereon a securing strip or flap 44, the latter being that portion of the top sheet 13 as it extends beyond the free edge 43. This securing strip 44 is formed solely by the top facing sheet 13 and hence constitutes a thin single-ply layer of paper. The securing strip 44 has a plurality of cuts or openings 47 formed therethrough, with the cuts or openings 47 being disposed substantially within a longitudinally extending row which is positioned substantially midway between the edges 43 and 46. The tamper-indicating sealing means 41 also includes an indicia strip 48 formed on the upper face thereof, which indicia strip 48 extends longitudinally throughout the length of the respective flap. This indicia strip 48 is normally of significant width, and is disposed adjacent but spaced slightly inwardly from but in parallel relationship to the free edge 43. The indicia strip 48 is preferably formed by printing or inking directly on the exposed outer surface of the outer facing sheet 13, and is also preferably of a bright and very visible color such as red or yellow.

The underside 49 of the securing strip 44 is adapted for adhesive securement and, for this purpose, an adhesive can be applied to the underside 49 if desired. Alternately, an adhesive can be applied to this underside 49 during the actual closing and sealing operation.

The manner in which the container 10 is formed and sealed will now be briefly described to ensure a complete understanding thereof.

The blank 11 is formed about the fold lines 21 to form a substantially tubular structure which is open at the ends, and the edge strip 22 is disposed so as to overlap the end wall 19 and is then adhesively sealed and stapled thereto. The flaps associated with both the bottom and top ends are then suitably closed, with the bottom flaps being initially closed and sealed, thereby permitting filling of the container, and the top flaps thereafter being closed and sealed. The closing and sealing of the bottom flaps is identical to the closing and sealing of the top flaps, and hence only the latter operation will be described.

To close and seal the top flaps, the inner top flaps 36–37 are folded inwardly toward one another about the fold line 31. When the box is of a rectangular (but not a square) configuration, these inner top flaps 36 and 37 do not overlap, at least up to the free edges 43, although the securing strips 44 may or may not overlap depending upon the shape of the box. Sealing together of these inner flaps is not normally done nor necessary since the sealing of the box is accomplished primarily by the outer flaps.

Figure 6:
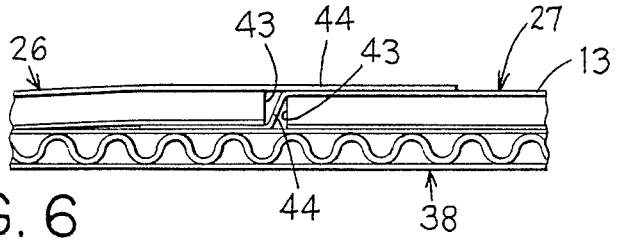
FIG. 6.is an enlarged fragmentary sectional view taken substantially along line VI—VI in FIG. 1 except that the flaps are shown in the closed and sealed position.

After inward folding of the inner flaps 36–37, then the outer top flaps 26–27 are folded inwardly about the fold line 31 so that the opposed free ends 43 thereof are disposed closely adjacent but generally slightly spaced from one another, substantially as illustrated by FIG. 6. During this folding of the flaps 26 and 27 into the closing position, one of the flaps such as the flap 27 is initially folded inwardly and its securing strip 44 is folded downwardly so as to directly overlie the inner flaps 36 and 37, and in fact this securing strip 44 can be adhesively secured directly to the upper surface of the inner flaps 36 and 37 if desired, substantially as illustrated by FIG. 6. Thereafter the other top flap 26 is folded inwardly so that its free edge 43 is disposed substantially directly opposite the free edge 43 of the flap 27. In this position, the securing strip 44 of the flap 26 overlaps the exposed upper surface of the flap 27 and in fact the cuts or openings 47 associated with the securing strip 44 of flap 26 are disposed directly over the colored indicating strip 48 associated with the flap 27 so that the bright color of the indicating strip is readily visible through the openings 47. In this closed position, the underside 46 of the securing strip 44 of flap 26 is then adhesively bonded to the upper surface of the flap 27 to sealingly secure the flaps 26 and 27 to one another and hence sealingly close the container 10.

With the container 10 in a sealed and closed condition as explained above, if anyone attempts to open the container to tamper with the contents thereof, and thereafter reseals the container, the unauthorized opening will require that the adhesive seal between the flap 27 and the overlapping securing strip 44 be broken. Any such breaking of the seal will necessarily cause the fibers associated with the paper defining the strip 44 to be substantially distorted so that, if the strip 44 is again resealed to the flap 27, the distortion caused by the previous unauthorized opening of the container will be readily evident inasmuch as the openings 47 will be distorted and such distortion will be readily observable in view of the fact that the openings 47 overlie the colored indicia strip 48.

In situations where the blank is formed with the sealing means 41 extending along both longitudinal edges of the blank, it is important that both sealing strips 44 be sealingly secured, such as the strip 44 of flap 27 to the underlying inner flaps 36 and 37, and the strip 44 of flap 26 to the flap 27. In this manner, any unauthorized opening requires that the seal or bond associated with both sealing strips 44 be opened and hence the openings 47 associated with both securing strips 44 will be distorted so as to prevent proper resealing of the box.

On the other hand, if it is desired to provide only a single seal, such as the securing of the strip 44 on flap 26 to the flap 27 as illustrated by FIG. 6, then the sealing means 44 should be provided solely along one longitudinal edge of the blank.

When the blank 11 is formed so as to define a container 10 having a square configuration, that is the width $W_2$ of all walls 16–19 is equal, then not only can the outer flaps 26 and 27 be sealed together in the manner described above, but the opposed inner flaps 36 and 37 similarly cooperate and hence can be sealingly engaged in the same manner illustrated by FIG. 6. This thus provides a double tamper-resistant seal for the container.

With the improved arrangement associated with the container 10 of the present invention, the container can be constructed of typical three-ply corrugated cardboard, and the seal between the cooperating closure flaps is formed integrally with the flaps so as to eliminate use of separate sealing elements or tapes. At the same time, the opposed closure flaps (such as 26 and 27) do not physically directly overlap and create an undesired thickness, but rather only the thin securing strip 44 which is integral with the outer facing layer 13 of the corrugated board overlaps the other closure flap and is sealingly engaged therewith. This greatly minimizes any overlap and, as illustrated by FIG. 6, provides a seal which does not have any significantly increased thickness such as would occur if the flaps 26 and 27 in their entirety overlapped one another. This improved sealing arrangement 41 as associated with the container 10 hence maintains relative flatness associated with the upper and lower surfaces of the sealed container, and thus facilitates the handling and particularly the stacking of such containers.

Figure 8:
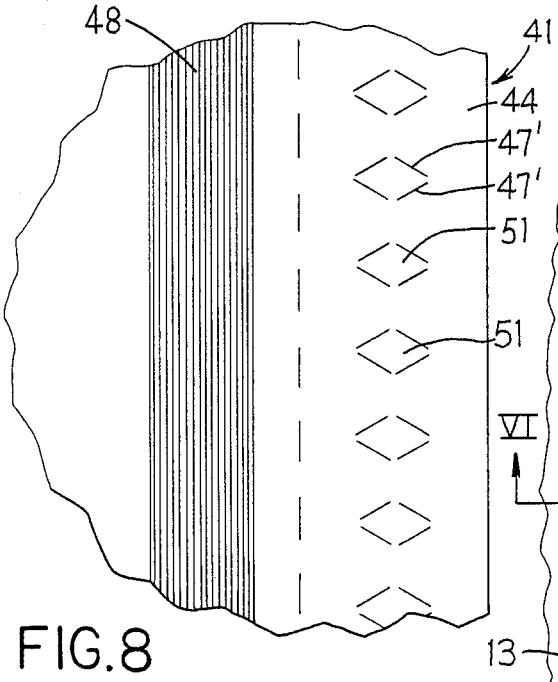
FIG. 8 is a view similar to FIG. 3 but illustrating a modification.
Figure 7:
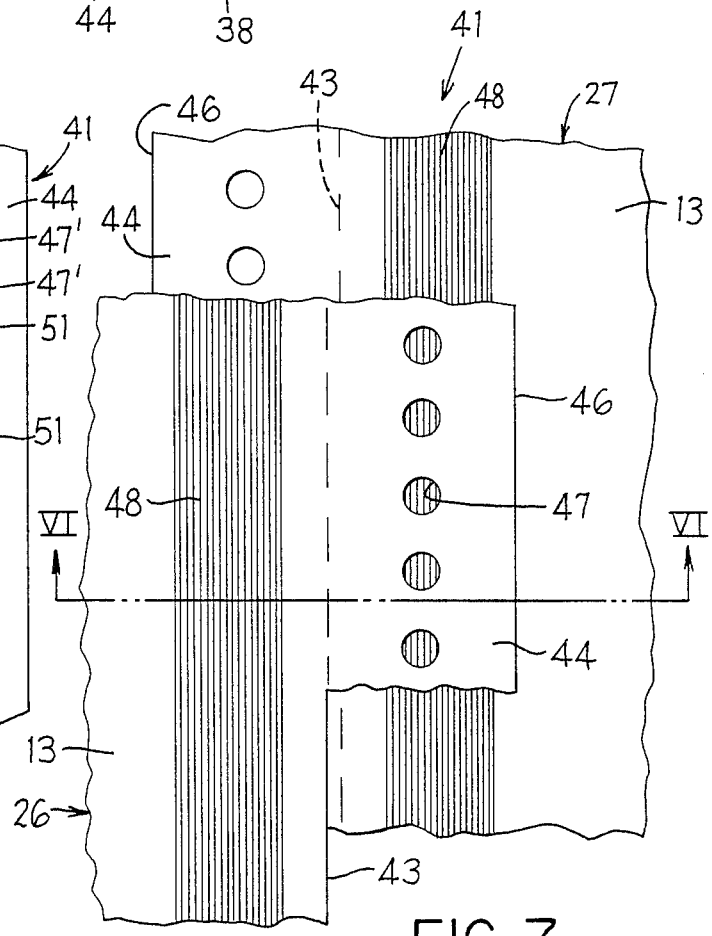
FIG. 7 is a fragmentary top view of FIG. 6.

While the container 10 as described above is provided with cuts 47 formed as openings, which openings can be of any desired configuration, it will be appreciated that the securing strip can be provided solely with cuts, such as the cuts 47' illustrated by FIG. 8. In such an arrangement, the cuts extend through the securing strip 44 but do not result in any material removal so that the underlying indicator strip would normally not be visible. However, if the seal is broken, then this causes sufficient distortion as to open up the cuts and hence the indicator strip would be readily visible if the strip were resealed. Further, by forming the cuts 47' so that a plurality of such cuts define an opening, such as a diamond or rectangle 51 as illustrated by FIG. 8, with the ends of adjacent cuts being separated by small noncut strips, then any unauthorized breaking of the seal will result in at least some of the diamonds 51 being torn from the securing strip 44 due to the diamonds 51 remaining adhesively secured to the indicator strip of the other flap. In such instance, any resealing of the securing strip will be readily visible due to the distortion and damage caused to the securing strip during the breaking of the prior seal.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A top-opening, tubular, tamper-evident container formed from a unitary blank of foldable multi-ply corrugated cardboard, the multi-ply corrugates cardboard defining said blank including a thin outer facing sheet and a thin inner facing sheet which are laminated together through at least one intermediate corrugated sheet, comprising:

a pair of opposed side wall panels and a pair of opposed end wall panels foldable joined to each other along parallel longitudinal fold lines to form a tubular structure open at the top and bottom ends;

top and bottom closure means for sealingly closing the opposite ends of said tubular structure in such a manner than either end can be opened without visually indicating that the carton has been opened in the event than an attempt is made to reseal it;

at least one said closure means including:

(a) a first closure flap foldably joined to one of said side panels along an edge thereof and projecting inwardly so as to partially close off the open end of the tubular structure, and a second closure flap foldably joined to the other side panel along an edge thereof and projecting inwardly therefrom toward said first closure flap to partially close off the open end of the tubular structure, said first and second closure flaps when in a closing position being disposed substantially within the same plane and in substantially perpendicular relationship to said side panels, said first and second closure flaps having free edges which extend longitudinally of the respective flaps and are disposed in closely adjacent but opposed relationship when the first and second closure flaps are in said closing position;

(b) tamper-indicating sealing means integrally associated with and directly sealingly cooperating between said first and second closure flaps in the vicinity of the free edges thereof;

(c) said tamper-indicating sealing means including a securing strip which projects outwardly beyond the free edge of said first closure flap so as to directly overlap the outer surface of said second closure flap when said closure flaps are in said closing position, said securing strip being an integral extension of said outer facing sheet, the underside of said securing strip being adhesively secured to the outer surface of said second closure flap, said securing strip having a series of cuts formed therethrough in spaced relationship longitudinally therealong so that said cuts are distorted if the seal between said securing strip and said second closure flap is broken;

(d) said tamper-indicating sealing means including a visually distinct indicator means provided on the outer surface of the second closure flap adjacent to the free edge thereof and extending longitudinally therealong, said visually distinct indicator means being disposed directly under the cuts in said securing strip when the latter is sealingly engaged with said second closure flap;

(e) said indicator means comprising an indicator strip which is of selected width and which extends longitudinally throughout the length of the second closure flap in closely adjacent relationship to the free edge, said indicator strip having a color which is different from the color of the outer surface of said second closure flap; and (f) said cuts defining geometric shapes which are disposed substantially in spaced relationship longitudinally along the securing strip, a plurality of said cuts defining each geometric shape so that breakage of the seal between the securing strip and said second closure flap causes at least some of said geometric shapes to be at least partially torn from the securing strip so as to form discrete openings which extend through said strip.

2. A top-opening, tubular, tamper-evident container formed from a unitary blank of foldable multi-ply corrugated cardboard, the multi-ply corrugated cardboard defining said blank including a thin outer facing sheet and a thin inner facing sheet which are laminated together through at least one intermediate corrugated sheet, comprising:

a pair of opposed side wall panels and a pair of opposed end wall panels foldably joined to each other along parallel longitudinal fold lines to form a tubular structure open at the top and bottom ends;

top and bottom closure means for sealingly closing the opposite ends of said tubular structure in such a manner that either end can be opended without visually indicating that the carton has been opened in the event than an attempt is made to reseal it;

at least one said closure means including:

(a) a first closure flap foldably joined to one of said side panels along an edge thereof and projecting inwardly so as to partially close off the open end of the tubular structure, and a second closure flap foldably joined to the other side panel along an edge thereof and projecting inwardly therefrom toward said first closure flap to partially close off the open end of the tubular structure, said first and second closure flaps when in a closing position being disposed substantially within the same plane and in substantially perpendicular relationship to said side panels, said first and second closure flaps having free edges which extend longitudinally of the respective flaps and are disposed in closely adjacent but opposed relationship when the first and second closure flaps are in said closing position;

(b) tamper-indicating sealing means integrally associated with and directly sealingly cooperating between said first and second closure flaps in the vicinity of the free edges thereof;

(c) said tamper-indicating sealing means including a securing strip which projects outwardly beyond the free edge of said first closure flap so as to directly overlap the outer surface of said second closure flap when said closure flaps are in said closing position, said securing strip being an integral extension of said outer facing sheet, the underside of said securing strip being adhesively secured to the outer surface of said second closure flap, said securing strip having a series of cuts formed therethrough in spaced relationship longitudinally therealong so that said cuts are distorted if the seal between said securing strip and said second closure flap is broken;

(d) said tamper-indicating sealing means including a visually distinct indicator means provided on the outer surface of the second closure flap adjacent to the free edge thereof and extending longitudinally therealong, said visually distinct indicator means being disposed directly under the cuts in said securing strip when the latter is sealingly engaged with said second closure flap;

(e) said cuts defining discrete openings which extend through said securing strip so that said indicator means is visible through said openings whenever said securing strip is sealingly secured to said second closure flap.

3. A container according to claim 2, wherein said indicator means includes an indicator strip which is of selected width and which extends longitudinally throughout the length of the second closure flap in closely adjacent relationship to the free edge, said indicator strip having a color which is different from the color of the outer surface of said second closure flap.

4. A container according to claim 2, wherein said bottom closure means is indentical to said top closure means.

* * * * *